US005921040A

United States Patent [19]

Glashouwer et al.

[11] Patent Number: 5,921,040

[45] Date of Patent: Jul. 13, 1999

[54] PANEL FRAME ASSEMBLY

[75] Inventors: Paul A. Glashouwer, County of Kent; David P. Noel; Walter C. Mrotz, III, both of County of Muskegon; Thomas A. Langworthy, County of Kent; Thomas E. Bruce, County of Allegan, all of Mich.

[73] Assignee: Knoll, Inc., East Greenville, Pa.

[21] Appl. No.: 08/868,083

[22] Filed: Jun. 3, 1997

[51] Int. Cl.[6] ..... E04H 1/00

[52] U.S. Cl. ..... 52/239; 52/481.2; 52/489.1

[58] Field of Search ..... 52/239, 242, 481.1, 52/481.2, 483.1, 489.1, 479

[56] References Cited

U.S. PATENT DOCUMENTS

| | | | |
|---|---|---|---|
| 3,345,787 | 10/1967 | Busscher | 52/242 |
| 3,386,216 | 6/1968 | Zwickert | 52/242 |
| 3,871,153 | 3/1975 | Birum, Jr. | 52/239 X |
| 4,567,698 | 2/1986 | Morrison . | |
| 4,685,255 | 8/1987 | Kelley . | |
| 4,876,835 | 10/1989 | Kelley et al. . | |
| 4,932,181 | 6/1990 | Baxter et al. . | |
| 4,993,205 | 2/1991 | Dull et al. . | |
| 4,996,811 | 3/1991 | Dull et al. . | |
| 5,003,740 | 4/1991 | Dull et al. . | |
| 5,005,325 | 4/1991 | Dull et al. . | |
| 5,013,112 | 5/1991 | Hellwig . | |
| 5,024,030 | 6/1991 | Morrison . | |
| 5,038,539 | 8/1991 | Kelley et al. . | |
| 5,056,577 | 10/1991 | DeLong et al. . | |
| 5,086,597 | 2/1992 | Kelley et al. . | |
| 5,175,969 | 1/1993 | Knauf et al. . | |
| 5,274,970 | 1/1994 | Roberts | 52/239 X |
| 5,277,005 | 1/1994 | Hellwig et al. . | |
| 5,277,007 | 1/1994 | Hellwig et al. . | |
| 5,309,686 | 5/1994 | Underwood et al. . | |
| 5,433,046 | 7/1995 | MacQuarrie et al. . | |
| B1 4,876,835 | 6/1992 | Kelly et al. . | |

FOREIGN PATENT DOCUMENTS

| | | | |
|---|---|---|---|
| 2630145 | 10/1989 | France | 52/242 |

*Primary Examiner*—Creighton Smith
*Attorney, Agent, or Firm*—Buchanan Ingersoll, P.C.

[57] ABSTRACT

A freestanding panel assembly for a modular office system is provided. A support frame includes top and bottom horizontal rails rigidly secured to a pair of vertical supports. A trough is attached to the top horizontal rail to provide a first cable pathway and a pair of feet are attached to the bottom horizontal rail. The feet provide a ledge to support a panel skin attached to the frame and define a second cable pathway for the panel assembly. The feet also include a leveling means. In a second embodiment, intermediate panel skin supports are attached to the frame, and define a third cable pathway therebetween. A top cover plate, bottom cover plate and beltway cover plate are removably attached to the frame. In this way, redesign and reconfiguration of the office panels are easily accomplished.

14 Claims, 5 Drawing Sheets

PANEL FRAME ASSEMBLY

BACKGROUND OF THE INVENTION

1. Field of the Invention

The present invention relates to open office system panel assemblies, and more particularly to panel assemblies having removable facing panel skins and easily accessible cable management pathways.

2. Description of the Prior Art

Modular office systems in which individual panel assemblies are used to configure large work areas are well known in the art. More recently, improvements have been made in both the look and functionality of the panel assemblies. Due to constantly changing work environments, it is desirable to have office systems which allow for ease of redesign and flexibility in the routing of power and communication cabling.

The requirement that the panels be freestanding typically requires heavy panel assemblies that must be rigidly secured to supporting frames. An example of one such partition panel assembly is U.S. Pat. No. 5,175,969 issued to Knauf et al. In that patent is disclosed a portable partition panel for open office plans in which the panel frame has attached thereto removable cover panels. The panels are secured to the frame by spring clips attached to the back of the panel skin which engage the frame support, as well as a top cap which rigidly secures the panels to the frame. While this system may allow for readily removable panel skins from the frame assembly, the support arrangement disclosed in Knauf et al. requires that the panel skin cover the full length and width of the panel frame.

It is desirable to allow for wiring through the frame assembly so that components can be attached anywhere within the office system. By way of example, it is commonly desirable to have what is referred to as a beltway electrical raceway within the panel, which beltway runs along an intermediate portion along the height of the panel. The support arrangement of Knauf et al., which necessitates a full length panel skin, does not allow for such construction. It is also desirable to provide panel skins that can be easily removed to install, for example, wiring through the support, after the office system has been configured, or when redesigning the office system and moving panel assemblies from location to location. Moreover, with today's electronically controlled work environment, the addition of telecommunication and data wires needs to be accommodated.

It is therefore an object of the present invention to provide a freestanding panel assembly having easily removable panel skins.

It is a further object of the present invention to provide a panel assembly which can be provided with leveling mechanisms so that the panels can be assembled on any work surface.

It is a still further object of the present invention to provide for separate electrical and telecommunication pathways within the panel to prevent electrical interference between the respective cables.

SUMMARY OF THE INVENTION

The above objects are attained by the present invention, according to which, briefly stated, a panel assembly comprises a frame having left and right vertical supports and top and bottom horizontal rails rigidly secured together to provide a support frame. A generally U-shaped wire trough is attached to the top horizontal rail, the trough having a downwardly projecting upper lip portion which defines an upper space between the upper lip portion and the top horizontal rail to provide an upper panel skin attachment member. One or more feet are attached to the bottom horizontal rail, each foot having an upwardly projecting lower lip portion so as to define a lower space between the lower lip portion and the bottom horizontal rail and to provide a lower panel skin attachment member. A panel skin is attached to the frame by being receivable between the upper lip portion and the lower lip portion to fit within the upper space and the lower space so as to provide a decorative outward appearance for the panel assembly.

In a further embodiment of the present invention, one or more foot members are provided for the panel assembly. Each foot member comprises a generally U-shaped member having a base and spaced apart parallel uprights. A first pair of generally L-shaped lip members are attached to each of the uprights so that a first vertical leg of the first lip member projects in an upward direction. A second pair of generally L-shaped lip members are attached to the base such that a second vertical leg of the second lip members projects in a downward direction. Thus, a vertical space is defined between the first and second L-shaped lip members. Preferably two feet are provided for each panel assembly such that laterally projecting horizontal members of the first pair of L-shaped lip members of the two feet define a ledge which supports the panel skin. The space between the first and second pair of lip members defines an electrical cable raceway, and a cover plate is provided between the pair of lip members.

The panel skins are attached to the panel frame using the lips on the bottom and top of the frame. The skin material is flexible enough to allow the skin to be placed on the bottom lip and flexed out enough to fit under the top lip. The skin is then released with the center portion of the skin securing to the vertical frame preferably using a snap fit feature. In detail, the panel skins are held at the top by the lip in the wire trough; and at the bottom of the panel the skins are held by the lips in the panel foot which is also supporting the weight of the skin. In addition, the panel foot holds the base raceway cover using a snap fit at the bottom and hook at the top of the cover. The base of the foot accepts the leveling glide and supports the full weight of the panel.

BRIEF DESCRIPTION OF THE DRAWINGS

Various other objects, features, and advantages of the invention will become more apparent by reading the following detailed description in conjunction with the drawings, which are shown by way of example only, wherein.

DETAILED DESCRIPTION OF THE PREFERRED EMBODIMENTS

Figure 4:
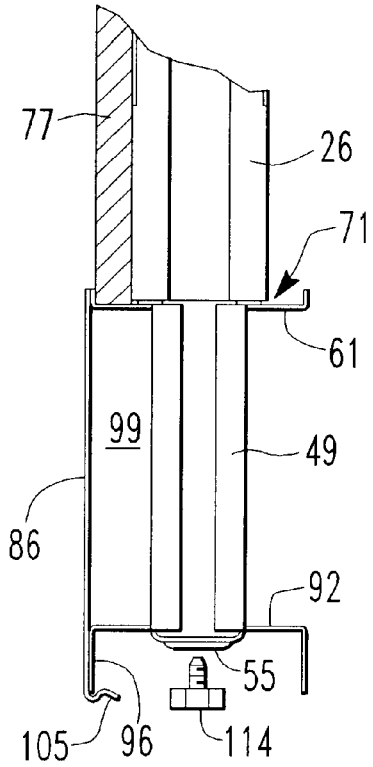
FIG. 4 is a detailed view of the bottom of the panel assembly of FIG. 3.
Figure 5:
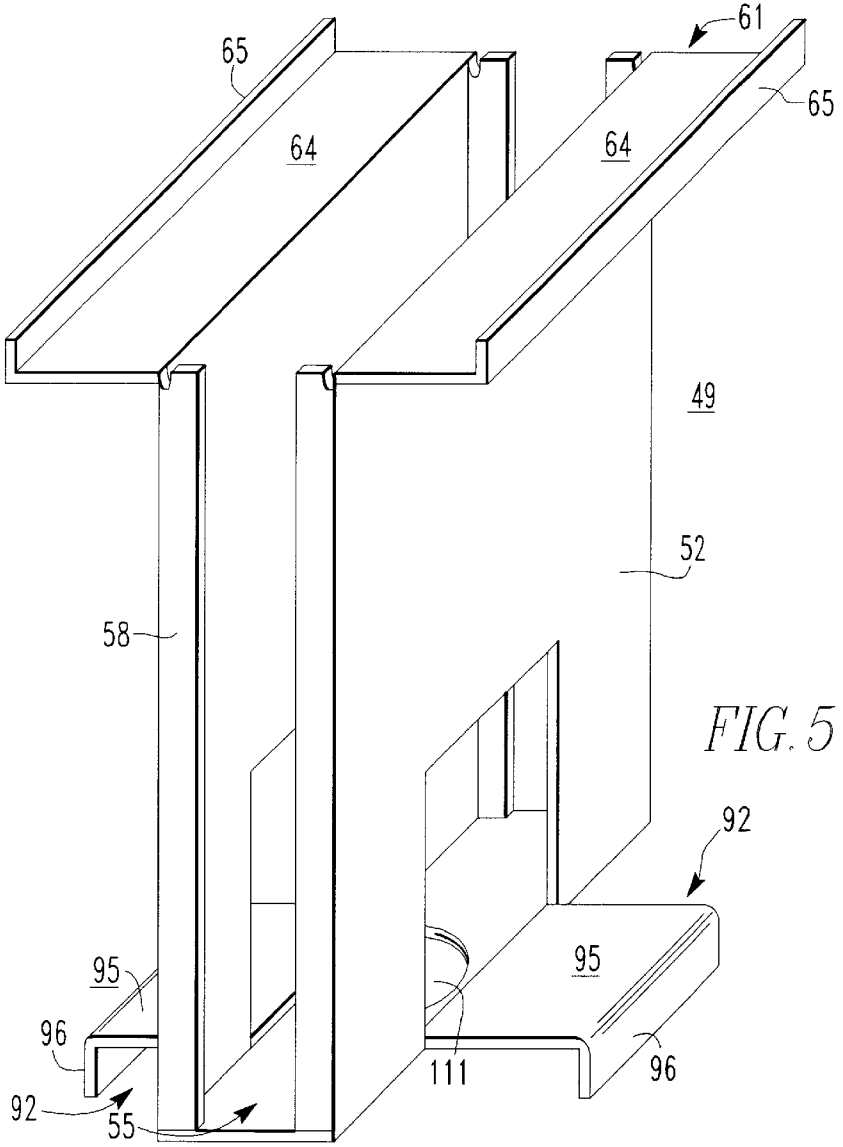
FIG. 5 is a detailed view of a foot member for the present invention.
Figure 6:
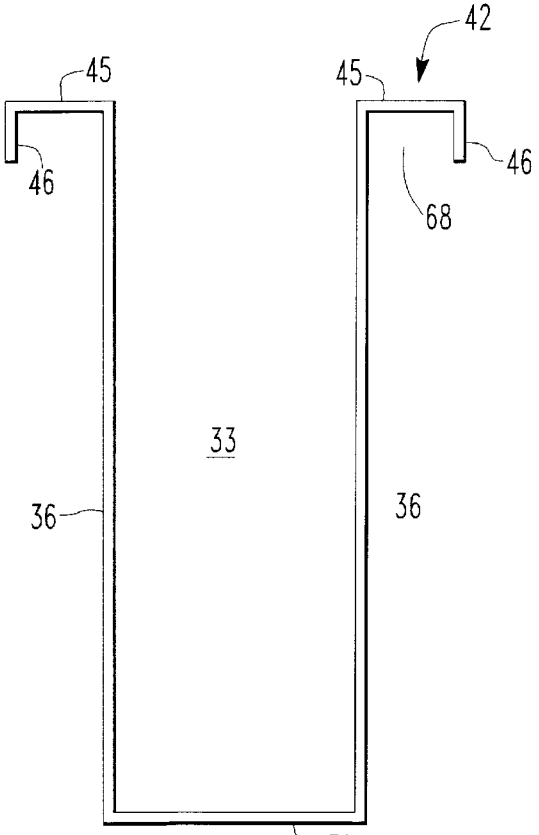
FIG. 6 is a detailed view of an upper wire trough having an upper panel skin attachment assembly according to the present invention.
Figure 7:
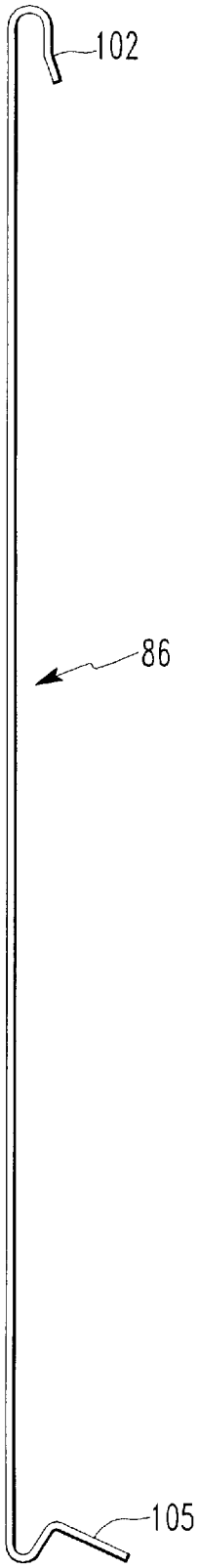
FIG. 7 is a detailed side view of a bottom cover plate for the present invention.
Figure 10:
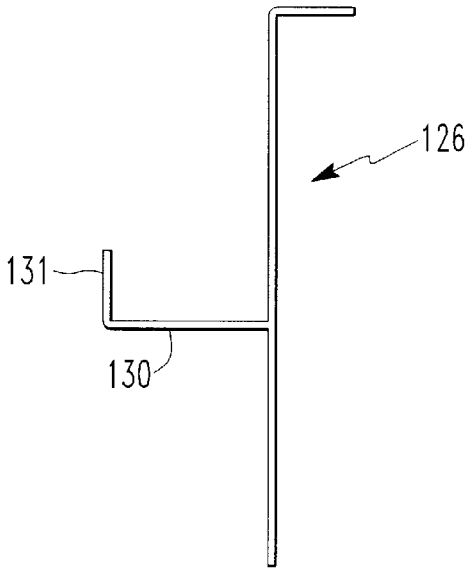
FIG. 10 is an intermediate panel skin attachment member according to the second embodiment of the present invention.
Figure 11:
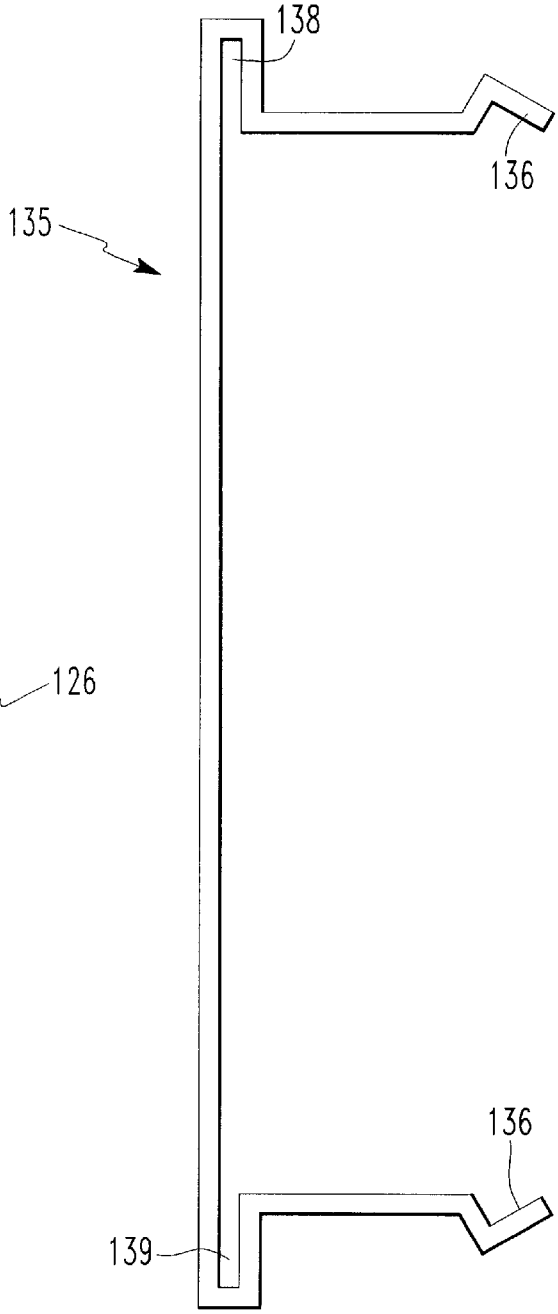
FIG. 11 is a side elevational view of a beltway cover plate for the second embodiment of the present invention.
Figure 8:
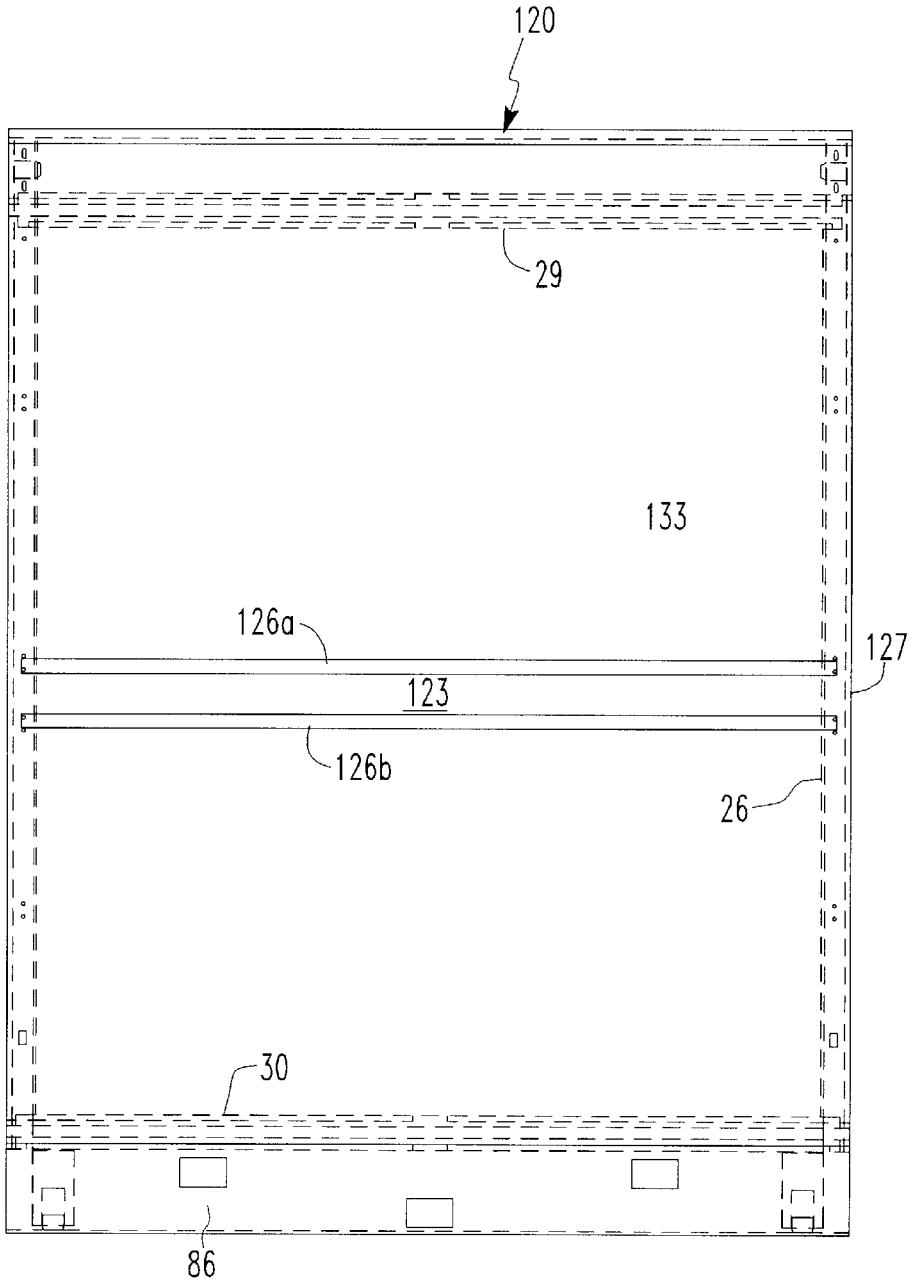
FIG. 8 is a front elevational view of a second embodiment of the present invention.
Figure 9:
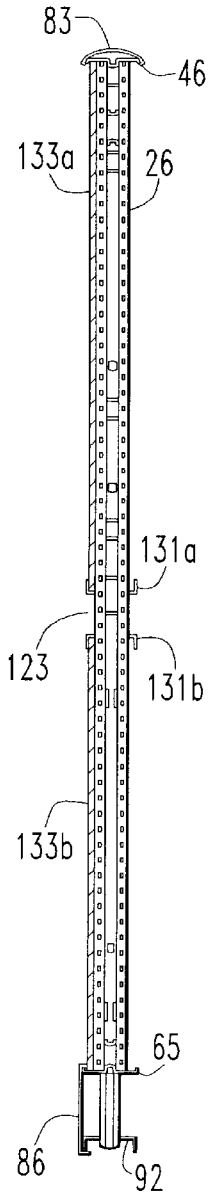
FIG. 9 is a side elevational view of the embodiment shown in FIG. 8.

Referring now to the drawings in detail, FIGS. 1–7 show one embodiment of a freestanding panel assembly 20 according to the present invention. The panel assembly is comprised of a frame support 23 which includes a pair of vertical supports 26 securely attached to a pair of top 29 and bottom 30 horizontal rails. The frame is preferably formed into a rigid structure by welding of the vertical and horizontal frame members. The frame has attached to the top horizontal rail 29 a generally U-shaped wire trough 33 (FIG. 6). The trough has a pair of spaced apart parallel uprights 36 projecting from a base 39 secured to the frame, each of the uprights having generally L-shaped lip members 42. The L-shaped lip members of the wire trough include a generally horizontal leg 45 and a generally downward projecting vertical leg 46.

Attached to the bottom support rail 30 are preferably two foot members 49. Each foot member comprises a second generally U-shaped member 52 having a base 55 and a second pair of spaced apart parallel uprights 58. Each of the uprights also comprises a second pair of lip members 61, having a generally longer horizontal member 64 which projects laterally outward from the frame and a vertically upwardly projecting lip member 65 (see FIG. 5). The feet 49 are preferably welded to the bottom rail 30.

The lip members 42 on the wire trough on the top of the frame 33 project downward so as to define a space 68 between the downwardly projecting upper lip portion 46 and the upper rail 29; likewise the lower lip members 65 attached to the feet project upward to define a space 71 between the lower lip members and the bottom rail 30. The upper lip member and lower lip member are spaced apart on the frame to define the panel skin attachment area 74 (shown in phantom in FIG. 2).

A panel skin 77 is attached to the frame 23, preferably on both the front and back sides. The panel skin is preferably comprised of a flexible core material such as fiberglass and a fabric or other decorative covering over the core. In order to attach the panel skin to the frame, the bottom portion of the panel skin 77 is placed onto and supported by the ledge created by the horizontal members 64 on the feet 49 on the bottom rail, and is bent or bowed 80 slightly (as shown in phantom in FIG. 2) so that the overall length of the panel skin is less than the spacing between the vertical legs 46, 65 of the upper and lower lip members, respectively. The top portion of the panel skin is then slid underneath the downward projecting leg 46 of the upper lip portion 42 and is allowed to resume its normal shape within the frame 23. As an added attachment scheme, especially for longer panel members, a fastener (not shown) may be provided at intermediate portions of the panel skin along the frame. Preferably, this intermediate attachment comprises a snap fit fastener so as to hold the panel skin 77 tightly against the support frame 23.

Figure 1:
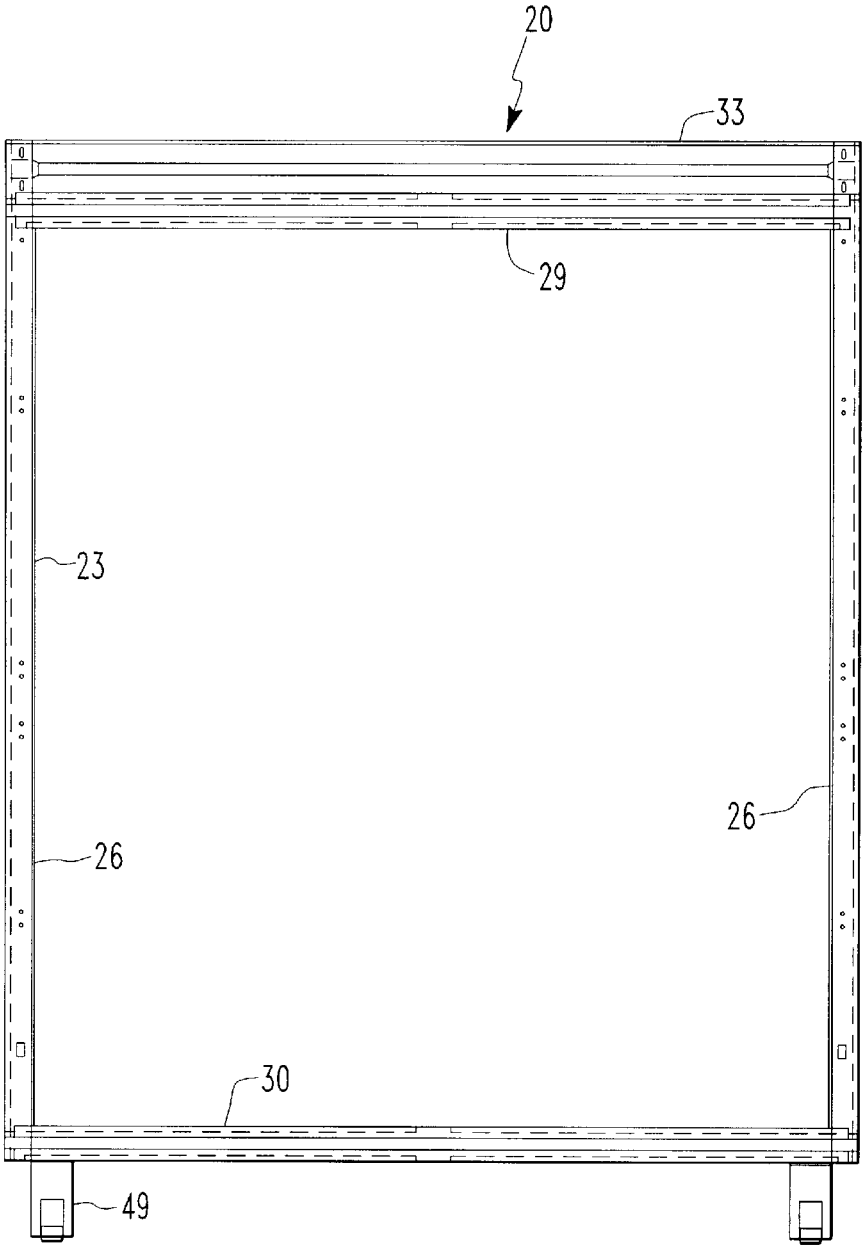
FIG. 1 is a front elevational view of a support frame for the present invention.
Figure 2:
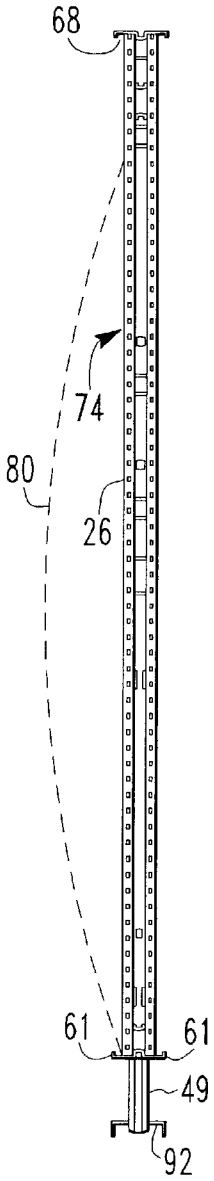
FIG. 2 is a side elevational view of the frame of FIG. 1.
Figure 3:
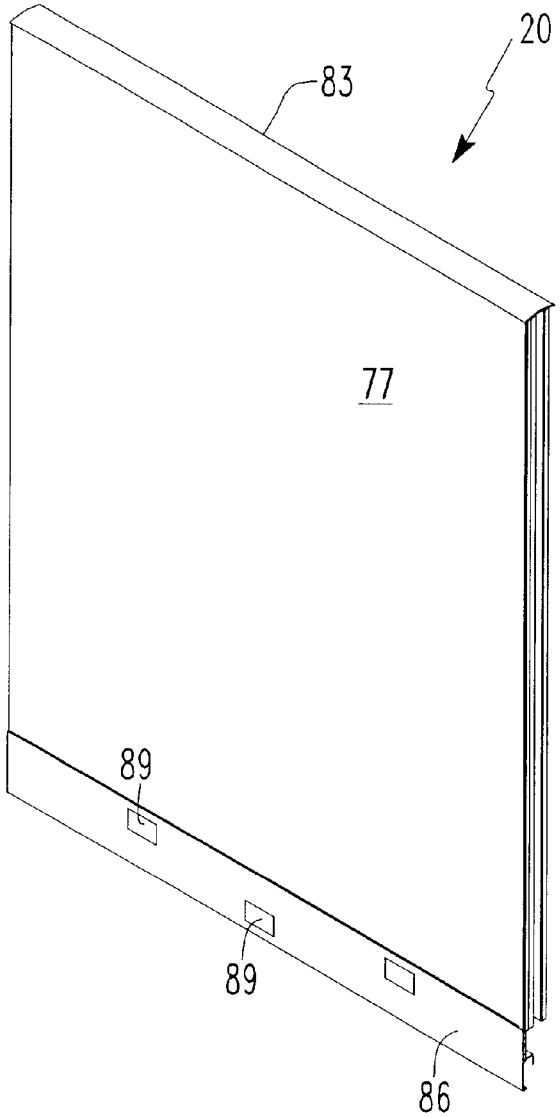
FIG. 3 is a perspective view of an assembled panel assembly according to one embodiment of the present invention.

Referring now to FIGS. 3 and 4 in detail, the assembled panel assembly is shown therein. As shown in FIG. 3, a top cap 83 and a bottom cover plate 86 are provided. The top cap includes an integral clip portion which resiliently fits around the two upper lip portions 45 on the wire trough 33. This provides a decorative covering for the top of the panel assembly 20 and is held snugly in place on the wire trough. The bottom cover plate 86 preferably includes one or more outlet openings 89 for the passage of electrical cabling, for example. The bottom cover plate (see FIG. 7) also includes clips that resiliently attach the bottom cover plate to the feet 49. As can be seen in FIGS. 4 and 5, each of the feet also includes a second pair of generally L-shaped lip members 92 attached adjacent to the base 55, and each having a horizontal portion 95 and a downwardly projecting vertical leg 96. The space 99 between the upper 61 and lower 92 lip members on the foot define a cable raceway. The bottom cover plate 86 snaps into place over the feet such as by snapping the lower clip portion 105 of the cover plate over the downwardly projecting vertical leg 96 and then snapping the top clip 102 onto the upwardly projecting lip member 65 of the foot. In this manner, electrical cabling can be routed through the panel assembly 20 and to electrical outlets provided in the openings 89. The cover plate is easily removable to allow for redesign and reconfiguration of the panel assembly and hence the office layout.

Another feature of each of the feet is a leveling means. Preferably the base member of the foot has an aperture 111 therein which accepts a threaded leveling screw 114 or glide, for example, which is vertically adjustable with respect to the foot and the panel assembly. The provides a range of vertical motion for the feet such that the panel assembly 20 can be maintained in a level orientation with respect to the floor. Such a leveling mechanism is well known in the art.

Referring now in detail to FIGS. 8–11, a second embodiment of a panel assembly 120 according to the present invention will be described. In order to provide a beltway raceway 123 through an intermediate portion of the panel assembly, upper 126*a* and lower 126*b* intermediate panel skin supports may be provided. The intermediate lip members 126 (FIG. 8) are attached to an intermediate portion 127 of the vertical supports 26 such as by screwing into place. Between the vertical supports an upper and lower intermediate panel skin support is attached to the frame and generally parallel to the upper 29 and lower 30 horizontal rails. The supports 126 include a horizontal member 130 and a vertical member 131. In this manner, half size panel skins 133 can be inserted into the respective intermediate upper and lower panel skin attachment members.

A top half panel skin 133*a* is placed on the horizontal member 130 of the upper intermediate panel skin support 126*a*. As with the full length panel skin, the top half panel skin 133*a* is bent or bowed slightly so that the overall length is less than the spacing between the vertical leg 46 of the upper lip member and the upward vertical member 131 *a*. It then resumes its normal full size. The bottom half panel skin 133*b* is similarly installed between the feet 49 and the lower intermediate panel skin support 126*b*. As is readily apparent, the upper and lower intermediate panel skin supports comprise the same component, rotated 180° with respect to each other.

This arrangement creates a gap for the beltway 123 in an intermediate height portion of the panel assembly. In this way a further cabling raceway is also provided within the panel assembly 120. After the requisite electrical or telecommunication cables have been placed through the panel within the beltway raceway, the beltway cover plate 135 (FIG. 11) is inserted onto the support frame 127. Attachment clips 136 on the beltway cover plate are received into the upper intermediate panel skin support 126*a* and the lower intermediate panel skin support 126*b*. Similar to the bottom cover plate 86, the beltway cover plate may also include outlet ports for electrical and/or telecommunication and data cabling.

The upper trough 33 also provides a cable pathway. In order to insert telecommunication or data cables, for example after the panel has been assembled, the top cap 83 is easily removed from its snap fit over the upper lip portions 46. Thus, communication cables can be laid into the trough 33 for connection within the office and the top cap can be reinstalled after cable routing is complete. In this manner, for example, the raceway provided by the feet and lower cover plate provides a separate cabling pathway for electrical cables, whereas the upper trough provides a separate cabling pathway for telecommunication and data cables so as to prevent electrical interference therebetween. Moreover, the beltway cableway can provide connections at the nominal height of a desk top (not shown) attached to the panel assembly 120.

Another feature of the panel assembly of the present invention is accessory support means provided in each of the vertical supports. Openings on the edges of the vertical supports are adapted to receive securement brackets for office panel accessories, in a manner which is well known in the art. Moreover, each of the vertical supports provides means for attaching individual panel assemblies together in an end to end fashion which are similar to the connectors described in U.S. Pat. No. 5,003,740, as well as providing L, T, or X-shaped connectors to provide the overall office layout.

An added feature of the present invention is that the panel skins are easily removable from the frame assembly. In this manner, in the event that more cabling is required to be routed through the panel or if other office accessories are required to be attached to the frame, the panels can be easily removed. To remove the top panel, for example, the cap 83 is removed so as to expose the upper lip portions. The panel is easily bent or bowed again so as to decrease the overall length of the panel skin such that the upper portion of the panel is removed from engagement with the upper lip portion. When the top of the panel is freed from the upper lip portion, a person need merely lift up on the panel skin to remove it from the ledge on the feet 49 or the intermediate lip member 126(*a*). In this manner, the panel assemblies can be redesigned such that a new panel skin having a different decorative covering can be installed so as to provide a new or fresh look for the office layout. In addition, the full length panel skins can be removed and upper and lower panel skins can be attached and the beltway raceway can be provided. In addition, should a panel skin become damaged it can easily be removed and replaced with a new one. Thus, the present invention offers may advantages in the ease of redesign of the office layout.

Therefore, the present invention provides an inexpensive, lightweight panel assembly that can be incorporated into an office design with other panel assemblies in an easily reconfigurable manner.

While specific embodiments of the invention have been described in detail, it will be appreciated by those skilled in the art that various modifications and alterations would be developed in light of the overall teachings of the disclosure. Accordingly, the particular arrangements disclosed are meant to be illustrative only and not limiting as to the scope of the invention which is to be given the full breadth of the appended claims and in any and all equivalents thereof.

We claim:

1. A panel assembly comprising:

a frame including left and right vertical supports and top and bottom horizontal rails;

a generally U-shaped trough attached to the top horizontal rail, said trough having a downwardly projecting upper lip portion so as to define an upper space between the upper lip portion and the top horizontal rail;

a foot attached to the bottom horizontal rail, the foot having an upwardly projecting lower lip portion so as to define a lower space between the lower lip portion and the bottom horizontal rail; and a panel skin, the panel skin being receivable between the upper lip portion and the lower lip portion and within the upper space and the lower space.

2. The panel assembly as set forth in claim 1, wherein the foot comprises:

a generally U-shaped member having a base and spaced apart parallel uprights;

a first pair of generally L-shaped lip members attached to each of said uprights such that a first vertical leg of said first lip member projects in an upward direction; and a second pair of generally L-shaped lip members attached to said base such that a second vertical leg of said second lip member projects in a downward direction.

3. The panel assembly as set forth in claim 2, wherein the foot further comprises a leveling means.

4. The panel assembly as set forth in claim 3, wherein the leveling means is comprised of an opening in the base and a leveling glide having a threaded portion and a head portion such that the threaded portion is threadingly engaged with the opening so as to be vertically adjustable with respect to the base.

5. The panel assembly as recited in claim 2, wherein said first and second lip members define a pathway therebetween and further comprising a bottom cover plate having means for resiliently attaching to said first and second lip members.

6. The panel assembly as recited in claim 5, wherein the pathway is adapted to receive electric power cables therein, and said bottom cover plate includes outlet openings therein for attachment of electrical outlets thereto.

7. The panel assembly as recited in claim 1, wherein said frame has a front side and a back side and the generally U-shaped trough includes two downward projecting upper lip portions, one on each of said front and back sides, the panel assembly further comprising a top cap having a clip portion attachable to both of said downward projecting lip portions.

8. The panel assembly as recited in claim 7, wherein said generally U-shaped trough is adapted to receive telecommunication cables therein.

9. The panel assembly as recited in claim 1, further comprising upper and lower intermediate lip members attached between said left and right vertical supports and generally parallel to said top and bottom horizontal rails and the panel skin comprises top and bottom panel skins, whereby said top panel skin is receivable between the upper lip portion and the upper intermediate lip portion and the lower panel skin is receivable between the lower lip portion and the lower intermediate lip portion.

10. The panel assembly as recited in claim 9, wherein said upper and lower intermediate lip portions define a beltway therebetween, and further comprising a beltway cover plate having means for resiliently attaching to said upper and lower intermediate lip portions.

11. A panel assembly comprising:

a frame including left and right vertical supports and top and bottom horizontal rails;

an upper panel skin attachment member secured to the top horizontal rail and projecting laterally outward therefrom, wherein the upper panel skin attachment member further comprises a generally U-shaped trough having first generally parallel uprights attached to the top horizontal rail, each of said first generally parallel uprights having a first horizontal member projecting laterally outward therefrom and an upper lip portion projecting downward from the first horizontal member so as to define an upper space between the upper lip portion and the top horizontal rail;

a lower panel skin attachment member secured to the bottom horizontal rail and projecting laterally outward therefrom, wherein the lower panel skin attachment member comprises at least two foot members secured to the bottom horizontal rail, each of said foot members further comprising a generally U-shaped member having a base and second generally parallel uprights, each of said second generally parallel uprights having a second horizontal member projecting laterally outward therefrom and a lower lip portion projecting upward from the second horizontal member so as to define a lower space between the lower lip portion and the bottom horizontal rail, said second horizontal members forming a ledge to support the panel skin thereon;

a panel skin, the panel skin being receivable between the upper and lower lip portions within the upper space and the lower spaces; and leveling means cooperatively associated with the base.

12. The panel assembly as recited in claim 11, wherein said leveling means comprises an opening in the base and a leveling glide having a threaded portion and a head portion such that the threaded portion is threadingly engaged with the opening so as to be vertically adjustable with respect to the base.

13. The panel assembly as recited in claim 11, wherein the frame further includes means for attaching accessory supports.

14. The panel assembly as recited in claim 11, wherein each of said left and right vertical supports further includes panel attachment means, whereby a left vertical support of a first panel assembly is attachable to a rigid vertical support of a second panel assembly.

* * * * *